United States Patent [19]

Wavering

[11] 4,411,282

[45] Oct. 25, 1983

[54] MASCARA APPLICATOR WAND AND RECEPTACLE

[75] Inventor: Karen A. Wavering, Chicago, Ill.

[73] Assignee: W. Braun Company, Chicago, Ill.

[21] Appl. No.: 357,978

[22] Filed: Mar. 15, 1982

[51] Int. Cl.[3] ..... A45D 40/30

[52] U.S. Cl. ..... 132/88.5

[58] Field of Search ..... 132/88.5, 88.7, 85; 15/206; 401/122

[56] References Cited

U.S. PATENT DOCUMENTS

| | | | |
|---|---|---|---|
| 3,692,417 | 9/1972 | Aston | 401/122 |
| 3,896,823 | 7/1975 | Spatz | 132/88.7 |
| 3,930,280 | 1/1976 | Vasas | 401/122 |

*Primary Examiner*—Gregory E. McNeill

*Attorney, Agent, or Firm*—Michael G. Berkman

[57] ABSTRACT

A mascara applicator comprising a series of edge-tapered ring-like discs disposed as an axially extending array along a rod-like wand. The discs have flexible marginal edges and define annular grooves therebetween, the grooves having varying depths. A receptacle for the applicator and for the mascara is provided with an opening having an integral annular restriction serving as a wiping ring to remove excess mascara from the applicator discs as the wand is axially withdrawn from the receptacle for cosmetic use. The upper end of the wand carries a cup-like closure for capping and sealing the receptacle, interimly, during periods of non-use.

13 Claims, 5 Drawing Figures

MASCARA APPLICATOR WAND AND RECEPTACLE

BACKGROUND OF THE INVENTION

The present invention relates to an applicator device for use with a cosmetic preparation. More particularly, the invention is directed to a mascara wand and to a receptacle therefor, and also serving as a mascara storage bottle.

Facial cosmetic arts and devices for practicing such arts are well known and long established in the literature and in the marketplace. One such art is the application of mascara for coloring and for intensifying the physical appearance of the eyelashes. Extensive research has been conducted in the cosmetic field not only toward improving the composition of mascara preparations but also to provide better devices by means of which the mascara may be effectively applied to the eyelashes. Brushes in various physical forms, wires, rods and spring-like bars have been used as mascara applicator means. Each device has one or more shortcomings and none has been found totally acceptable in use.

Most applicators are not adapted to and have failed to accommodate the physical distribution of the eyelashes along the lateral expanse of one's eyelids. Others have provided inadequate control as to the quantity of mascara to be presented for application to the lashes. Still others have, in use, objectionably gripped or snagged the eyelashes themselves. Some applicators have exhibited poor life qualities and have suffered premature physical deterioration in use. None is self-cleaning. It is, therefore, a principal aim of this invention to obviate some of the shortcomings of prior art mascara applicators and to provide an applicator wand of generally improved usefulness for the purpose intended.

SUMMARY OF THE INVENTION

It is a principal feature of the present invention that the mascara applicator wand is provided with a coaxial lineally extending array of disc-like rings spaced at their periphery to define annular mascara-receiving and carrying grooves.

A related feature of the invention is that the discs are generally V-shaped in cross section to define recesses which flare radially outwardly from a longitudinally axially extending core of the wand.

Yet another structural feature of the mascara applying wand of the invention is that the washer-like discs are resiliently flexible to enhance both the safety and the utility of the applicator.

An important additional advantage of the wand of the invention is the provision of grooves or slots of varying radial depth for accomodating mascara in varying amounts for the application, selectively, to specific lineal segments of one's eyelashes.

Another feature of the invention is that there is provided an improved closure or cap for the mascara receptacle. The closure is at the base of the handle portion of the applicator wand and has a sealing zone at the inner lip of the mouth of the receptacle. A related feature is that the closure at the receptacle mouth is a self-aligning resilient seal.

Yet antoher feature of the invention is that part of wand core is generally oval in cross section to provide slots which vary in depth along a circumscribing annular path.

In a preferred embodiment of the invention the mascara carrying slots includes slots of at least two different depths.

It is a collateral feature of the invention that the wand is adapted for penetrating insertion into a storage receptacle having a constricted neck portion including an annular wiping ring for stressingly engaging and resiliently deforming peripheral margins of the flexible annular ribs, thereby to wipe excess mascara from the wand as the latter is withdrawn for the receptacle for use.

A related feature of the invention is that the wand is formed with a handle and with a socket for coupling engagement with the neck of the mascara storage receptacle to effect sealing closure of the receptacle to protect the contents thereof.

Other and further objects, features and advantages of the instant invention will become evident from the following detailed description considered with the drawings.

DESCRIPTION OF THE PREFERRED EMBODIMENT

The aims and objects of the invention are achieved through utilization of an improved mascara applicator or wand characterized in that it constitutes a wand which supports a lineal array of disc-like washers disposed axially along the wand. The washers or discs are flexible and are so contoured as to form slot-like annular recesses between adjacent discs, the recessing serving as mascara-carrying cavities. In a preferred embodiment of the invention, the interspatial annular recesses include recesses of two or more different depths for accommodating different lineal segments of one's eyelashes. The applicator wand also serves as the closure for the receptacle in which the mascara is stored.

Figure 1:
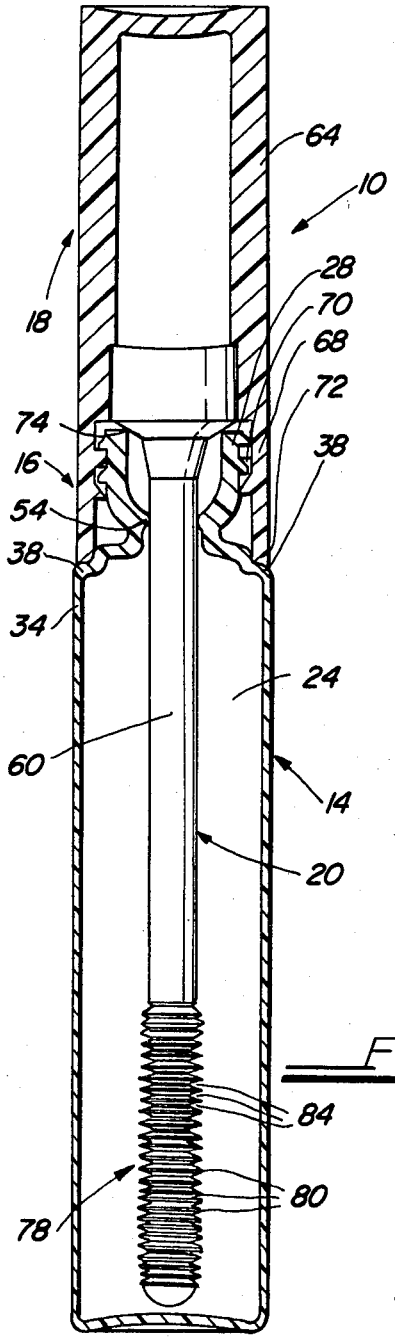
FIG. 1 is a front elevational view, partly in section, illustrating the mascara wand of the invention, and the receptacle therefor.

Referring now to the drawings, and particularly to FIG. 1, for purposes of illustrative disclosure, a preferred embodiment of the invention is shown as a mascara storage receptacle and applicator wand assembly 10. The assembly 10 includes a generally tubular receptacle or container 14 for holding the mascara (not shown), and a combination applicator wand and container closure 18. The applicator wand 20 is shown as lodged coaxially within the chamber 24 of the receptacle 14.

Figure 2:
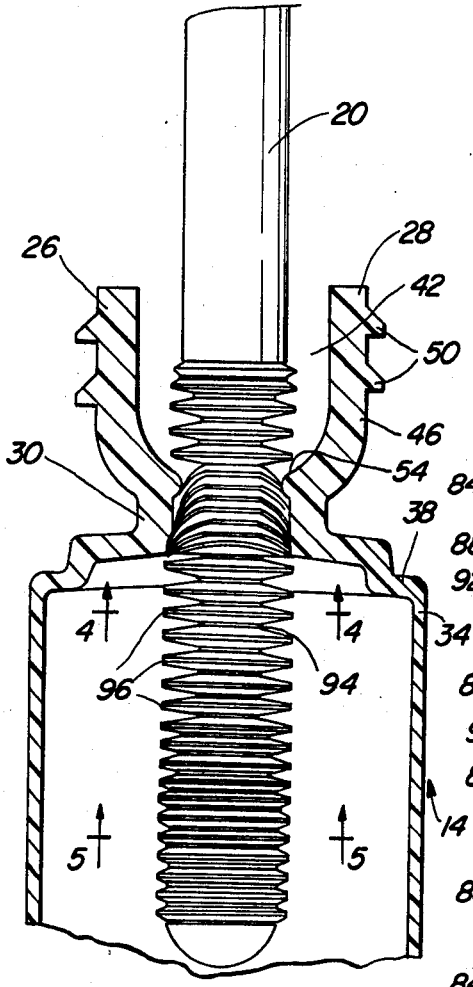
FIG. 2 is an enlarged fragmentary view indicating, schematically, the mascara wand being drawn through the wiping ring of the storage receptacle.

The container is preferably of a rigid plastic construction and is integrally formed below an open upper end wall 26, to define a throat 28 leading to a restricted neck 30. The neck 30 is connected to a side wall 34 of the receptacle 14 through an integrally formed annular shoulder 38 (FIGS. 1 and 2).

Surmounting the neck 30 and coaxial therewith is a flared generally cylindrical mouth 42 the outer wall 46 of which is threaded 50 externally. In a preferred embodiment of the invention there is provided annular wiping ring 54 (FIG. 2) constituting a bead integrally formed with the neck 30 of the receptacle 14 and projecting radially inwardly of the neck 30.

The applicator wand 20 of the invention includes an elongated rod 60 surmounted by a handle portion 65. The base (shown in section in FIG. 1) of the handle portion 64 is a hollow, open-ended skirt 68 having internal threads 70 for mating engagement with cooperating threads 50 of the container end 28 so that the handle-carried skirt 68 serves as an outer closure for the container 14.

Adjacent its upper end, the wand 20 includes a frustoconical collar 74 or convex flange fabricated of a yieldable pressure-responsive flexible material. As shown in FIG. 1 the undersurface of the flange 74 resiliently abuts to seal against an inner lip edge portion 28 of the end of the container 14 when the latter is capped, further obviating solvent evaporation from the interior of the container 14.

The "functional" or applicator part 78 of the wand 20 constitutes a series of disc-like rings 80 distributed as a coaxial array to extend from a lower lineal section of the rod 60. Lateral faces of adjacent rings are spaced to define circumscribing grooves 84 for holding mascara for application to one's eyelashes. In a preferred form of the invention the rings 80 taper from thick or inner hub portions 88 to more narrow radially outwardly directed ends 92 so that the grooves 84 between the disc-like rings 80 are generally V-shaped in cross-section and constitute tapered recessed flared radially outwardly for retaining controlled amount of mascara.

Figure 3:
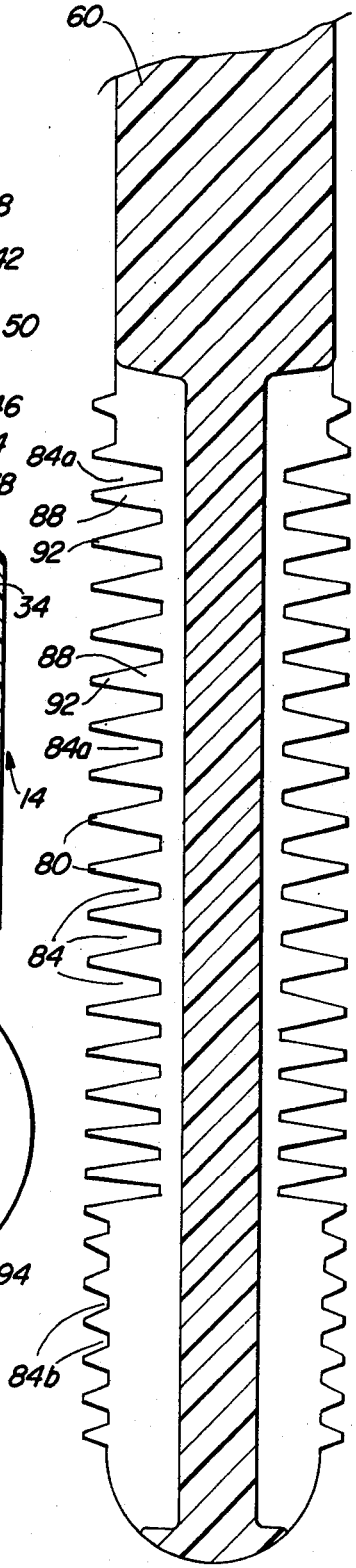
FIG. 3 is an enlarged fragmentary view of the mascara wand and the receptacle of the invention, illustrating a preferred distribution of disc-defined annular mascara-carrying grooves of varying radial depth extending along the wand.

Further control of the amount of and the physical placement of the mascara carried by the ring array is achieved by the novel expedient of forming the grooves 84 to provide varying depths. As seen best in FIG. 3, the groove depth varies along incremental lengths of the lineal array of discs 80. For example, grooves 84*a* at the upper extremity of the applicator 78 are deep, and the grooves 84*b* in the next successive lineal increments are more shallow.

Figure 4:
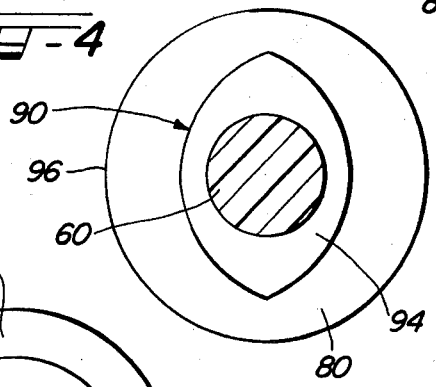
FIG. 4 is a cross-sectional view taken on the lines 4—4 of FIG. 2.
Figure 5:
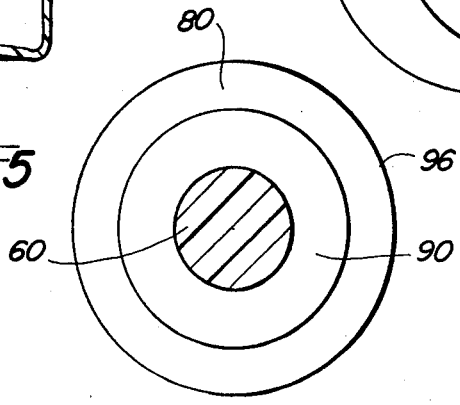
FIG. 5 is a cross-sectional view taken on the lines 5—5 of FIG. 2.

It is an important feature of the present invention that the applicator 78 is structured so as to carry predetermined varying quantities of mascara in the grooves 84 distributed along the length of the applicator 78. As best seen in the cross-sectional views of FIGS. 4 and 5, to this end, this wand 20, at the applicator portion 78 thereof, has a core 90 which is of an inconstant cross-sectional contour, further to control the mode of mascara application and also the quantity of mascara carried in the grooves 84 between adjacent pairs of rings 80 disposed along the length of the core 90. In the specific preferred embodiment of the apparatus shown, the core 90, at the lower section of the applicator 78 (at the "detail" lash rings), is round in transverse section. At its upper zone 94, the core 90 is generally oval in cross section to facilitate curling of the lashes during application of mascara thereto.

The discs 80 are preferably round and are made of somewhat firm but resilient plastic, rubber, or rubber-like material. As shown in FIG. 2, the discs 80 have a transverse (diametric) dimension which slightly exceeds that of the wiping ring 54 of the neck 30 through which the applicator 78 of the wand 20 is introduced into and through which it is withdrawn from the container 14. It will be appreciated upon consideration of the structure illustrated (FIG. 2) that as the wand 20, with the attached discs 80, is withdrawn from the receptacle 14 containing the mascara, the discs 80 delineating the mascara-carrying recesses 84 are flexed, deformed or bent somewhat as they pass through the lesser diameter wiping ring 54, and excess mascara is removed leaving a controlled quantity in the applicator sector 78 of the wand 20, and simultaneously cleaning the marginal edge 96 of the discs 80.

What is claimed is:

1. A mascara applicator wand assembly comprising an elongated rod having an upper handle end and having a lower applicator end, said lower applicator end including applicator means for applying mascara to eyelashes for cosmetic purposes, said applicator means comprising disk-like rings distributed as a coaxial array attached to and encircling said rod means at said lower applicator end thereof, said rings including resiliently flexible radially outwardly directed marginal rib portions having convex peripheral edges, said rings defining therebetween continuous annular grooves opening outwardly for retaining controlled amounts of mascara for cosmetic application, said annular grooves including grooves of varying radial depth distributed axially along side applicator end of said rod to provide shallow and deeper recesses between said rings for retention of lesser and greater amounts of mascara to be applied cosmetically.

2. The structure as set forth in claim 1 wherein said rings are fabricated of an elastomeric material distortable upon application of forces thereagainst.

3. The structure as set forth in claim 1 wherein said rings are essentially round in diametric cross section.

4. The structure as set forth in claim 1 and further comprising receptacle means for mascara storage and for protected storage of said mascara applicator wand therein during periods of non-use, said receptacle means comprising an elongated open-top container of a lineal expanse to receive said applicator end of said wand therein with said handle end of said wand projecting therefrom, said receptacle means including a body portion and a surmounting neck portion, said neck portion including wiping ring means for frictionally wiping said applicator means, said wiping ring means defining a restricted orifice having an internal diameter less than a diameter of said rings of said applicator means, and said wiping ring means comprising restricted passage means for said rings for applying radial pressure inwardly against said rings to flex and wipe said rings upon passage of said rings axially through said orifice, for limiting the amount of mascara carried by said applicator end of said wand and for removing excess mascara therefrom.

5. The structure as set forth in claim 4 and further comprising closure means for capping said receptable means, said closure means including means embracing said handle end of said wand, and securement means for removably fastening said closure means on said receptacle means in fluid-tight sealing engagement therewith.

6. The structure as set forth in claim 5 wherein said closure means is unitary with said handle end of said wand.

7. The structure as set forth in claim 5 wherein said securement means comprise thread means carried by said receptable means and by said closure means for intercoupling sealing engagement.

8. The structure as set forth in claim 1 wherein said grooves of varying radial depth include grooves of at least two different depths.

9. The structure as set forth in claim 1 wherein said grooves include grooves having inconstant radial depths along an annular traverse thereof, and wherein said grooves having inconstant depths are grooves which are symmetrical with respect to said rod means.

10. The structure as set forth in claim 5 and further comprising collar means carried by said handle end of said rod, said collar means abutting a top edge of an open top of said receptacle means in resiliently stressing fluid-tight sealing engagement therewith to prevent evaporation of fluid from said container.

11. A mascara applicator wand assembly comprising an elongated rod having an upper handle end and having a lower applicator end, said lower applicator end including applicator means for applying mascara to eyelashes for cosmetic purposes, said applicator means comprising disk-like rings distributed as a coaxial array attached to and encircling said rod means at said lower applicator end thereof, said rings including resiliently flexible radially outwardly directed marginal rib portions, said rings defining therebetween annular grooves opening outwardly for retaining controlled amounts of mascara for cosmetic application, and said grooves defining an undulating annular path at radially inward limits thereof.

12. The structure as set forth in claim 1 wherein said annular grooves are generally V-shaped in cross-section to define tapered recesses flared radially outwardly.

13. The structure as set forth in claim 1 wherein the radial depth of each of said grooves at each axial position along said rod means is essentially constant as measured from a peripheral margin of said rings inwardly toward said rod means.

* * * * *